US005233794A

United States Patent [19]

Kikutani et al.

[11] Patent Number: 5,233,794

[45] Date of Patent: Aug. 10, 1993

[54] ROTARY TOOL MADE OF INORGANIC FIBER-REINFORCED PLASTIC

[75] Inventors: Yoshifumi Kikutani, Tokyo; Kenji Kikuzawa, Moriyama; Isao Tajima, Osaka; Kazuo Sato, Funabashi, all of Japan

[73] Assignee: Nippon Steel Corporation, Tokyo, Japan

[21] Appl. No.: 574,679

[22] Filed: Aug. 30, 1990

[30] Foreign Application Priority Data

Mar. 1, 1989 [JP] Japan ..... 1-046618

[51] Int. Cl.[5] ..... B24D 3/04

[52] U.S. Cl. ..... 51/206 NF; 51/206 R; 51/295; 51/298; 51/307

[58] Field of Search ..... 51/206 R, 206 NF, 209 R, 51/209 DL, 295, 296, 298, 307, 308, 309

[56] References Cited

U.S. PATENT DOCUMENTS

| | | | |
|---|---|---|---|
| 3,619,150 | 11/1971 | Rinker | 51/295 |
| 3,661,544 | 5/1972 | Whitaker | 51/295 |
| 3,663,191 | 5/1972 | Kroder | 51/295 |
| 3,918,218 | 11/1975 | Zoiss | 51/295 |
| 4,227,350 | 10/1980 | Fitzer | 51/295 |
| 4,253,850 | 3/1981 | Rue | 51/296 |
| 4,525,178 | 6/1985 | Hall | 51/309 |
| 4,809,467 | 3/1989 | De Fazio | 51/206 NF |
| 4,913,708 | 3/1990 | Kalinowski | 51/295 |
| 5,009,676 | 4/1991 | Rue et al. | 51/309 |
| 5,035,723 | 7/1991 | Kalinowski et al. | 51/308 X |

FOREIGN PATENT DOCUMENTS

| | | |
|---|---|---|
| 54-4800 | 3/1979 | Japan . |
| 59-97845 | 6/1984 | Japan . |
| 63-47374 | 6/1989 | Japan . |

OTHER PUBLICATIONS

Nikkan Kogyo Shinbunsha, "Kogyo Zairyo (Industrial Material)", vol. 37, No. 1, 1989.

*Primary Examiner*—Bruce M. Kisliuk
*Assistant Examiner*—John A. Marlott
*Attorney, Agent, or Firm*—Pollock, Vande Sande & Priddy

[57] ABSTRACT

A rotary tool for cutting, drilling, grinding, or polishing metallic or non-metallic materials is made of a compact material, which consists of an inorganic fiber reinforced plastic containing 50 to 81 volume % of inorganic long fibers selected from the following group: alumina fibers, boron fibers, silicon carbide fibers, and silicon nitride fibers, the remaining portion of the compact material consisting of a thermosetting resin matrix.

7 Claims, 3 Drawing Sheets

ROTARY TOOL MADE OF INORGANIC FIBER-REINFORCED PLASTIC

BACKGROUND OF THE INVENTION

1. Field of the Invention

This invention relates to a tool for cutting, drilling, grinding, or polishing metallic or non-metallic materials. More specifically, this invention relates to a rotary tool which is suitable for cutting, drilling, grinding, or polishing metals such as iron, aluminum, and copper, or alloys of such metals, or non-metallic materials such as stone, monocrystalline or polycrystalline silicons, and ceramics.

2. Description of the Related Art

Plastics which are reinforced with inorganic long fibers are well known as "FRP". For example, in "Kogyo Zairyo (Industrial Material)", Vol. 37, No. 1, (published in 1989 by Nikkan Kogyo Shinbunsha) there is disclosed a FRP consisting of an alumina fiber reinforced epoxy resin. Such FRPs have been utilized in the field of structural members.

Examples of well-known conventional rotary tools include the carborundum grindstone and the alumina grindstone. The carborundum grindstone, for example, consists of a porous material that is manufactured by binding carborundum abrasive grains together by means of a binder. Because of its porous structure, however, it cannot contain a sufficient amount of abrasive grains, resulting in a rather poor working efficiency. In addition, its pores will become clogged with chips, so that it is subject to early deterioration in cutting quality.

Japanese Patent Examined Publication No. 54-4800 and Japanese Patent Unexamined Publication No. 59-97845 disclose a buffing material and a grindstone, which consist of porous materials made of glass fibers. However, glass fibers exhibit a low degree of hardness, so that their field of application is limited. Moreover, they are all porous, which means they are rather poor in working efficiency and subject to clogging.

Japanese Patent Application No. 63-47374 discloses a lapping material containing inorganic fibers. This lapping material, however, cannot be applied to a rotary tool; that is for a tool which is to be held at a certain angle with respect to the surface to be lapped.

SUMMARY OF THE INVENTION

It is accordingly an object of this invention to provide a novel rotary tool which can perform cutting, drilling, grinding, and polishing operations with a higher efficiency than conventional grindstones and which is free from clogging during its operation. That is, with a rotary tool in accordance with this invention, an excellent working efficiency can be secured by use of a plastic material which contains a large amount of a hard substance corresponding to the abrasive grains of a grindstone for cutting workpieces and, at the same time, since no clogging occurs, an excellent cutting quality can be maintained for a long time.

In accordance with this invention, there is provided a rotary tool made of a compact (not porous) material which contains 50 to 81 volume % of inorganic long fibers selected from the following group: alumina fibers, boron fibers, silicon carbide fibers, and silicon nitride fibers, the remaining portion of the compact material consisting of a thermosetting resin matrix.

DETAILED DESCRIPTION OF THE PREFERRED EMBODIMENTS

Figure 1A:
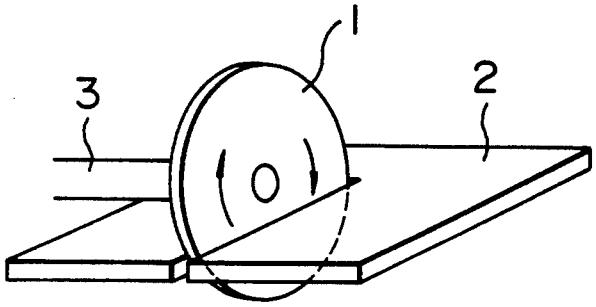
FIGS. 1A and 1B show examples of the rotary tool in accordance with an embodiment of this invention.

This invention employs inorganic long fibers with a high degree of hardness instead of conventional abrasive grains constituting grindstones. Alumina fibers, boron fibers, silicon carbide fibers, and silicon nitride fibers provide an excellent cutting quality since they have a sufficiently high degree of hardness.

The inorganic long fibers employed in this invention may have a small diameter, which is in the range, for example, of 3 μm to 30 μm.

The rotary tool of this invention is made of a material containing 50 to 81 volume % of such inorganic long fibers, which are bound compact together by means of a binder so that the material would have no pores.

As stated above, conventional grindstones are porous and have a lot of pores, their abrasive grain content being 50 volume % or less. In contrast, the material or the rotary tool in accordance with this invention contains 50 volume % or more of inorganic long fibers such as $Al_2O_3$-type fibers, which constitute the cutting elements. Accordingly, the cutting edge for cutting workpieces exhibits a high density, so that a higher working efficiency can be attained than with a conventional grindstone, along with less wear of the tool being involved. Since it has a compact structure without any pores, the tool material of this invention does not become clogged with chips, whereas the pores of conventional grindstones are liable to be filled with chips, which would cause damage to the surface of the workpiece. With the rotary tool of this invention, the thermosetting resin constituting the matrix is worn somewhat earlier than the inorganic long fibers, so that the rotary tool exhibits a brush-like working surface, with inorganic long fibers slightly protruding from the matrix surface. These inorganic fibers protruding in a brush-like manner serve as the cutting elements, providing a high cutting efficiency. The chips remaining on the workpiece are removed by the brush-like inorganic long fibers of the working surface as the rotary tool rotates.

The inventors have found out that the rotary tool of this invention, which is made of a material containing 50 volume % of inorganic long fibers, can be used without particularly taking into consideration the angle of application with respect to the workpiece since it can provide an excellent cutting quality in all directions. In accordance with this invention, the protruding inorganic long fibers constitute the cutting edge, which means, by employing inorganic long fibers with a small diameter, the cut end surface, polished surface, and the like of the workpiece can be made smooth and fine. Generally, the greater the inorganic long fiber amount is, the better. An inorganic long fiber content of more than 81 volume %, however, will exceed the upper limit of the density in which the fibers can be packed, resulting in a defective impregnation of the thermosetting resin. The thermosetting resin to be employed in this invention may be: an epoxy resin, an unsaturated polyester resin, a vinyl ester resin, a bismaleimide resin, a phenol resin, and the like. Of these resins, an epoxy resin would be most suitable for manufacturing a rotary tool since it can firmly adhere to the inorganic long fibers without generating any pores.

The inorganic fiber reinforced plastic of this invention can be manufactured as follows: first, a thermosetting resin such as an epoxy resin is placed, for example, on a film in a certain thickness. Then, 50 to 81 volume % of inorganic fibers that are cut in an appropriate length are evenly dispersed on it, with the fibers being oriented in a variety of ways. Afterwords, thermosetting resin is placed on these fibers, thus sandwiching the inorganic long fibers between layers of thermosetting resin. By pressing the whole thing from both above and below with rollers or the like, the layer of inorganic long fibers is impregnated with the thermosetting resin without generating any pores. The sheet of material thus obtained is left to stand at a certain temperature for several days so as to put it in a B-stage (a half-cured condition which is suitable for pressurizing and curing through heating). Afterwards, a required number of sheets of the material thus obtained are superimposed on each other and are heated to be cured under pressure, thereby obtaining a compact plate having no pores.

A compact plate whose inorganic long fibers are oriented in the same direction and which includes no pores, can be obtained by, for example, superimposing unidirectional prepregs on each other in such a manner that the fibers are oriented in the same direction and then curing the plate thus obtained through pressurizing in an autoclave.

A compact poreless plate in which half of the inorganic long fibers are oriented in one direction and in which the remaining inorganic long fibers are oriented in the direction perpendicular this one direction, can be obtained by superimposing cloths which are woven with warps and wefts of inorganic long fibers, binding them together by means of a thermosetting resin and molding them into a compact plate under sufficient pressure.

Further, a compact plate having no pores can also be obtained in the following manner: first, prepregs are prepared by impregnating inorganic-fiber cloths with a thermosetting resin. Then, a large number of such prepregs thus obtained are superimposed on each other and are sufficiently pressed between heating plates. Apart from this, a poreless compact plate in which inorganic long fibers cross each other at right angles or are mutually inclined, can be obtained in the following manner: first, layers of inorganic long fibers are prepared which are impregnated with a thermosetting resin and in which the inorganic long fibers are oriented in the same direction, as described above. Then, these layers are put in the B-stage to obtain UD prepregs (unidirectional prepregs). A large number of such UD prepregs are superimposed on each other, with their fibers being oriented in the same direction. Afterwards, another layer is formed thereon, in which the fibers are oriented at right angles or inclined with respect to the fibers of the layers obtained by superimposing UD prepregs as described above. Then, a large number of UD prepregs are superimposed thereon in such a manner that the fibers of each layer are at right angles or inclined with respect to the adjacent layer. The layers thus superimposed together are sufficiently pressed to become a compact plate.

In accordance with still another method, a compact plate in which inorganic fibers are arranged in parallel or cross each other, can be obtained in the following manner: inorganic fibers impregnated with a thermosetting resin are wound around a cylinder in parallel with its periphery or diagonal thereto. The fiber coil thus obtained is cut open in the axial direction to obtain plate-like portions, which are cured separately through heating in an autoclave, or, instead, a large number of such plate-like portions may be laminated together. Alternatively, they may be pressed using a heating die.

The inorganic fiber reinforced plastic manufactured by one of these methods is processed using, for example, a diamond grindstone, thereby easily obtaining a rotary tool in accordance with this invention which has a desired configuration.

Figure 1B:
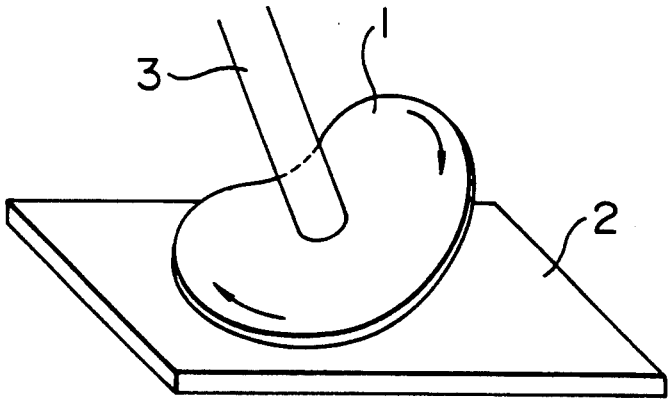

In accordance with this invention, a disc-like rotary tool is provided, which is adapted to rotate around its axis. Examples of such a rotary tool are shown in FIGS. 1A and 1B, of which FIG. 1A shows a rotary tool for cutting and FIG. 1B shows a rotary tool for grinding or polishing.

In accordance with this invention, a rotary tool is provided, which is composed of a rotating tip 5 and a rotation shaft 3 for rotating this rotating tip 5, the rotation shaft 3 and the rotating tip 5 being formed integrally of an inorganic fiber reinforced plastic.

Figure 2A:
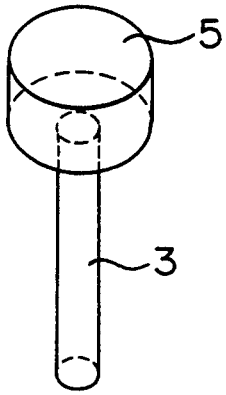
FIG. 2A PRIOR ART
FIGS. 2A and 2B respectively show a conventional grindstone and an example of the rotary tool in accordance with another embodiment of this invention.
Figure 2B:
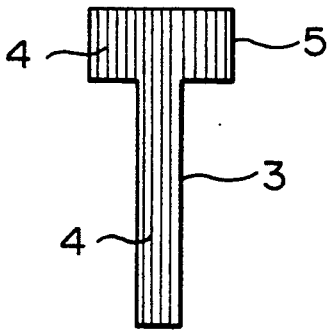

FIG. 2B shows an example of such a rotary tool. In a conventional carborundum grindstone, as shown in FIG. 2A, a carborundum rotating tip 5 is fixed to a steel rotation shaft 3 by means, for example, of an adhesive agent.

The operation of thus putting these parts together is bothersome. In addition, the joint section is not strong enough in many cases. In contrast, the rotating tip 5 of the rotary tool of this invention, which is shown in FIG. 2B, is formed integrally with the associated rotation shaft 3. That is, the rotary tool of this invention is in the form of an integral body made of an inorganic fiber reinforced plastic. As shown in FIG. 2B, the inorganic fibers 4 of the rotary tool of this invention may be arranged in the axial direction of the rotation shaft 3. Such arrangement is advantageous in that the high-strength rotation shaft 3 is formed integrally with the rotating tip 5, with no joint section existing between them.

In accordance with this invention, the rotating tip of a rotary tool of the above-described type has a disc-like or a cylindrical configuration. As stated above, a rotary tool in accordance with this invention is made of an inorganic fiber reinforced plastic which contains a large amount of inorganic fibers 4. Accordingly, the outer peripheral surface of the rotating tip 5 shown in FIG. 2B also exhibits a fine cutting edge with high density suitable for cutting workpieces, so that, even though the inorganic fibers 4 are arranged, for example, in parallel with the outer peripheral surface of the cylinder, it is not necessary to particularly take into consideration the angle of application with respect to the workpiece, thus providing an excellent cutting quality in all directions.

Figure 3A:
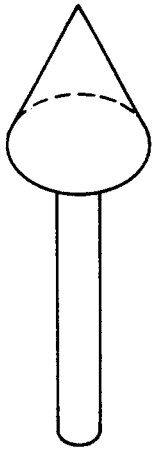
FIGS. 3A to 3F show examples of the rotary tool in accordance with, still another embodiment of this invention.
Figure 3B:
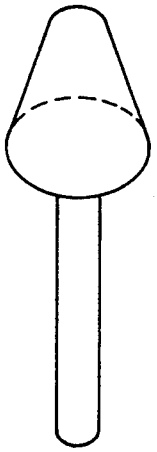
Figure 3C:
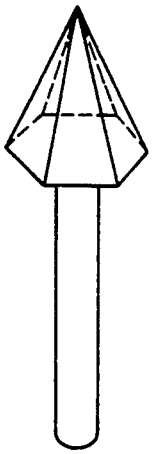
Figure 3D:
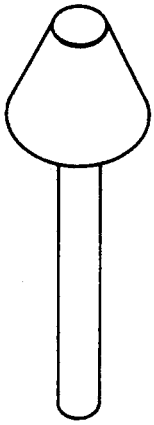
Figure 3E:
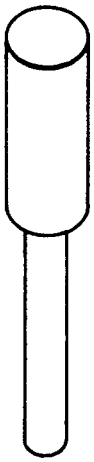
Figure 3F:
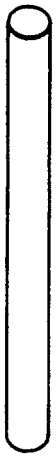

In accordance with this invention, the rotating tip of a rotary tool may have a cylindrical, a conical, a pyramid-like, or a truncated-cone-like configuration. FIGS. 3A to 3F show examples of such rotating tips, of which FIGS. 3A and 3B show conical rotating tips; FIG. 3C shows a pyramid-like rotating tip; FIG. 3D shows a truncated-cone-like rotating tip; FIG. 3F shows a cylindrical rotary tool in which the rotating tip and the rotation shaft have the same diameter; and FIG. 3E shows a rotary tool in which the diameter of the rotating tip is different from that of the rotation shaft. The "conical" configuration in this invention includes ones with a rounded tip (FIG. 3B) as well as those with a pointed tip (FIG. 3A). Likewise, the "pyramid-like" and the "truncated-cone-like" configurations naturally include ones which are not exactly to be called as such in the geometrical sense but are only approximately so. Rotary tools having such configurations are suitable for drilling workpieces, or grinding or polishing recesses in workpieces.

Figure 4:
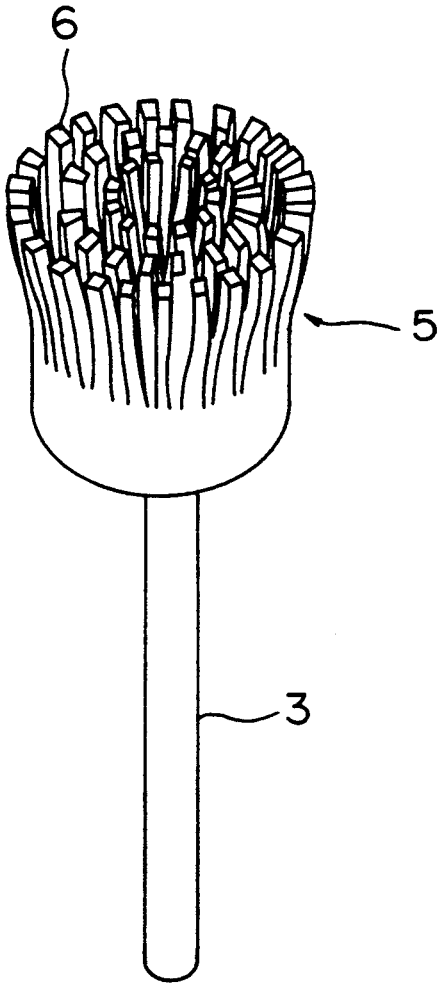
FIG. 4 shows an example of the rotary tool in accordance with still another embodiment of this invention.

In accordance with this invention, the rotating tip is formed as a column or a cylinder with a brush-like configuration. FIG. 4 shows an example of such a rotating tip. The rotating tip 5 shown has elements 6 which correspond to the bristles of a brush. Each of these elements 6 is also made of an inorganic fiber reinformed plastic which contains 50 to 81 volume % of inorganic fibers and exhibits a high-density fine cutting edge for cutting workpieces. When applied to a workpiece, its elements 6 are bent in conformity with the surface of the workpiece while the tool rotates, which means this rotary tool is suitable for grinding surfaces having complicated configurations or for grinding workpieces with a smooth finish.

Embodiments

A test was performed as follows: a workpiece, which consisted of a steel plate (S45C), was ground by moving rotary tools back and forth twenty times over a distance of 100 mm.

Each rotary tool had a disc-like configuration and had an outer diameter of 150 mm and a thickness of 1.0 mm. The grinding performed was of a dry type; each rotary tool was pressed against the workpiece with the same force and was moved back and forth at the same speed while rotating it at a speed of 3,000 r.p.m.

Rotary tool No. 1 is in accordance with this invention and is made of a compact material containing 60 volume % of alumina long fibers.

Rotary tool No. 2 is only different from rotary tool No. 1 in that it is made of a material which contains alumina long fibers having a diameter of approximately 10 μm.

Rotary tool No. 3 is a comparison example, which is made of a material containing 20 volume % of alumina long fibers with a diameter of 15 μm.

Rotary tool No. 4 is a comparison example, which is made of a material containing 20 volume % of alumina long fibers with a diameter of 10 μm.

Rotary tool No. 5 is a comparison example, which is made of a material containing approximately 76 volume % of glass long fibers.

Table 1 shows the results of the grinding test. Rotary tool No. 1 cut the workpiece approximately 1.4 mm deep while being moved back and forth 20 times. No clogging occurred, and the rotary tool was in a condition in which it could continue the operation with the same efficiency. Rotary tool No. 2 cut the workpiece 1.3 mm, without involving any clogging. Rotary tools 3 and 4 were inferior to Rotary tools 1 and 2 in terms of cutting depth, but involved little clogging due to their compact structure.

Rotary tool 5 proved very poor in terms of cutting depth because of its material containing glass fibers.

TABLE 1

| Tool No. | Type of cutting elements | Vol. % of elements contained | Binder type | Holes | Cutting depth (mm) | Clogging |
|---|---|---|---|---|---|---|
| 1 | Aluminous fibers ϕ15 μm | 60 | Epoxy | None | 1.4 | None |
| 2 | Aluminous fibers ϕ10 μm | 60 | Epoxy | None | 1.3 | None |
| 3 | Aluminous fibers ϕ15 μm | 20 | Epoxy | None | 0.4 | None |
| 4 | Aluminous fibers ϕ10 μm | 10 | Epoxy | None | 0.3 | None |
| 5 | Vetreous fibers ϕ23 μm | 76 | Epoxy | None | — | Some |

As is apparent from the above description, the rotary tool of this invention contains a large amount of hard inorganic long fibers, so that it has a fine cutting edge containing cutting elements in a high density. Accordingly, it is superior to conventional grindstones in terms of working efficiency.

Furthermore, the inorganic long fibers of the rotary tool of this invention are firmly retained by thermosetting resin, so that the tool can enjoy a long service life than grindstones, whose abrasive grains are subject to detachment.

Since the material of the rotary tool according to this invention is made compact and has no pores, it involves no clogging, always providing an excellent cutting quality.

By employing inorganic fibers with a small diameter, the rotary tool of this invention can have a fine cutting edge with high density, so that it is suitable for cutting workpieces with a fine and smooth section or obtaining a smooth polished surface.

In addition, since the rotating tip is formed integrally with the rotation shaft, the rotary tool of this invention has no joint section, so that it is easy to manufacture and provides a reliable degree of strength.

What is claimed is:

1. A rotary tool made of a compact poreless inorganic fiber reinforced plastic material which consists essentially of about 50 to 81 volume % of inorganic long fibers selected from the following group: alumina fibers, boron fibers, silicon carbide fibers, and silica nitride fibers, the remaining portion of said compact inorganic reinforced plastic material consisting of a thermosetting resin matrix, wherein said rotary tool includes a rotating tip and a rotation shaft for rotating said rotating tip, said rotating tip and said rotation shaft being integrally formed of said inorganic fiber reinforced plastic.

2. A rotary tool as claimed in claim 1, wherein said rotating tip has a disc-like configuration.

3. A rotary tool as claimed in claim 1, wherein said rotating tip has a conical configuration.

4. A rotary tool as claimed in claim 1, wherein said rotating tip is formed as a cylinder having a plurality of bristles extending from a surface thereof to form a brush-like configuration.

5. A rotary tool as claimed in claim 1, wherein said rotating tip has a cylindrical configuration.

6. A rotary tool as claimed in claim 1, wherein said rotating tip has a pyramidal configuration.

7. A rotary tool as claimed in claim 1, wherein said rotating tip has a truncated-cone configuration.

* * * * *

UNITED STATES PATENT AND TRADEMARK OFFICE

CERTIFICATE OF CORRECTION

PATENT NO. : 5,233,794

DATED : Aug. 10, 1993

INVENTOR(S) : Yoshifumi Kikutami, et al

It is certified that error appears in the above-identified patent and that said Letters Patent is hereby corrected as shown below:

On title page, delete the following:
Priority Data"

"[30] Foreign Application Priority Data

March 1, 1989 [JP] Japan.....1-046618 "

Signed and Sealed this

Third Day of May, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,233,794

DATED : August 10, 1993

INVENTOR(S) : Yoshifumi Kikutani, et al.

It is certified that error appears in the above-identified patent and that said Letters Patent is hereby corrected as shown below:

On the title page at [73] under Assignee, add the following additional Assignees:

-- I.N.T. Co., Ltd., 2-1, Honmachi-1-chome, Chuo-ku, Osaka-shi, Japan; and Nippon G. C. Industry Co. Ltd., 35-5, Shibayama-5-chome, Funabashi-shi, Japan --

Signed and Sealed this

Twentieth Day of December, 1994

*Attest:*

Bruce Lehman

BRUCE LEHMAN

*Attesting Officer*

*Commissioner of Patents and Trademarks*